US007308212B2

(12) United States Patent
Hamada et al.

(10) Patent No.: US 7,308,212 B2
(45) Date of Patent: Dec. 11, 2007

(54) COLOR IMAGE FORMING APPARATUS

(75) Inventors: Shuta Hamada, deceased, late of Hachioji (JP); by Akira Hamada, legal representative, Hyogo (JP); by Yoshiko Hamada, legal representative, Hyogo (JP); Yotaro Sato, Hachioji (JP); Takenobu Kimura, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 0 days.

(21) Appl. No.: 11/359,131

(22) Filed: Feb. 22, 2006

(65) Prior Publication Data

US 2006/0228136 A1 Oct. 12, 2006

(30) Foreign Application Priority Data

Apr. 8, 2005 (JP) ..... 2005-112198

(51) Int. Cl.
*G03G 15/00* (2006.01)
*G03G 15/16* (2006.01)

(52) U.S. Cl. ..... 399/49; 399/296

(58) Field of Classification Search ..... 399/296, 399/40, 302, 308

See application file for complete search history.

(56) References Cited

U.S. PATENT DOCUMENTS 5,923,920 A * 7/1999 Ishida et al. ..... 399/46
6,434,348 B1 * 8/2002 Tomizawa ..... 399/66
7,013,105 B2 * 3/2006 Omata ..... 399/296
2003/0123910 A1 * 7/2003 Kim et al. ..... 399/296

FOREIGN PATENT DOCUMENTS

JP 01191171 A * 8/1989
JP 08248829 A * 9/1996
JP 10-274892 10/1998
JP 11-143255 5/1999
JP 2001331003 A * 11/2001
JP 2002072609 A * 3/2002

* cited by examiner

*Primary Examiner*—David M. Gray
*Assistant Examiner*—Erika J. Villaluna
(74) *Attorney, Agent, or Firm*—Cantor Colburn LLP

(57) ABSTRACT

The color image forming apparatus, having: an intermediate transfer member; a plurality of image forming sections provided along the intermediate transfer member; a primary transfer device provided along the intermediate transfer member to transfer toner images formed on each image forming section so that the toner images are superimposed on the intermediate transfer member; a secondary transfer device provided downstream side of the primary transfer device to transfer superimposed toner images through bias voltage; a discharging device having a grid and a discharge electrode provided between the primary transfer device and secondary transfer device; a image density sensor provided along the intermediate transfer member to detect an amount of toner adhesion on the intermediate transfer member; and a control device to control the applied voltage for the discharge electrode in accordance with output of the image density sensor.

8 Claims, 4 Drawing Sheets

COLOR IMAGE FORMING APPARATUS

This application claims priority from Japanese Patent Application No. 2005-112198 filed on Apr. 8, 2005, which is incorporated hereinto by reference.

BACKGROUND

The present invention relates to a copying machine, a printer, a facsimile machine and a color image forming apparatus of an electrophotographic method having the aforesaid functions, and in particular a color image forming apparatus having an intermediate transfer member on which color toner images are superimposed.

What is commonly known as an image forming apparatus of an electrophotographic method using an intermediate transfer member is one wherein a toner image formed on an image carrier representing a photoconductor is transferred onto the intermediate transfer member, and the toner image on the intermediate transfer member is transferred onto a transfer material (also called a recording sheet or a sheet). In such a color image forming apparatus, the color images formed has various toner layers (adhesion amount) from half tone in a single color to superimposed three solid colors. Generally, a condition of secondary transfer is set to suit a toner adhesion amount of single solid color. However, when an amount of toner adhesion is large because of super imposed two solid colors, a transfer rate of the toner in a bottommost layer is low so that color shading tends to occur.

As a countermeasure for such a phenomenon, it is known that a good transfer performance can be obtained by reducing the electric potential of a superimposed toner layer to that of single solid toner layer. As a means for it, prior to secondary transfer, the electric potential of the toner layer on the intermediate transfer member is discharged through corona discharge. In particular, in order to adjust the electric potential of the toner layer to a predetermined electric potential, a means to discharge using scorotron electrode is effective.

However, in neutralization for the toner layer, if neutralization is excessive, the adhesion force for toner to the intermediate transfer member becomes weak and thereby, images are deteriorated due to toner dispersing. Therefore, an appropriate electric potential of the toner layer is needed.

Each of Patent documents 1 and 2 discloses a technique to charge toner images before secondary transfer, in which, however, voltage of the same polarity as that of toner is applied to the discharge electrode (wire), because its purpose is pre-transfer charge.

(Patent Document 1) Unexamined Japanese Patent Application Publication No. Tokkaihei 10-274892

(Patent Document 2) Unexamined Japanese Patent Application Publication No. Tokkaihei 11-143255

Since the toner layer voltage relates to a charge amount of toner as well as to an amount of toner adhesion, it varies depending on environmental and condition of use. To obtain good transferability of secondary transfer, any toner layer voltage is needed to be adjusted to an appropriate toner layer voltage after neutralization by the discharging device provided before the secondary transfer.

An object of the present invention is to provide an image forming apparatus capable of obtaining an image having neither color shading nor toner dispersing wherein a charge amount of toner is predicted to control an discharging device before the secondary transfer thereby the secondary transfer is carried out in good condition.

SUMMARY OF THE INVENTION

To resolve aforesaid problems and to achieve the object, the present invention has the structures below.

The color image forming apparatus, having: an intermediate transfer member; a plurality of image forming sections provided along the intermediate transfer member; a primary transfer device provided along the intermediate transfer member to transfer toner images formed on each image forming section so that the toner images are superimposed on the intermediate transfer member; a secondary transfer device provided downstream side of the primary transfer device to transfer superimposed toner images through bias voltage; a discharging device having a grid and a discharge electrode provided between the primary transfer device and secondary transfer device; a image density sensor provided along the intermediate transfer member to detect an amount of toner adhesion on the intermediate transfer member; and a control device to control the applied voltage for the discharge electrode in accordance with output of the image density sensor.

DESCRIPTION OF THE PREFERRED EMBODIMENT

While the preferred embodiment of the present invention have been described using specific terms, such description is for illustrative purposes only, and it is to be understood that changes and variations may be made without departing from the spirit or scope of the appended claims.

Figure 1:
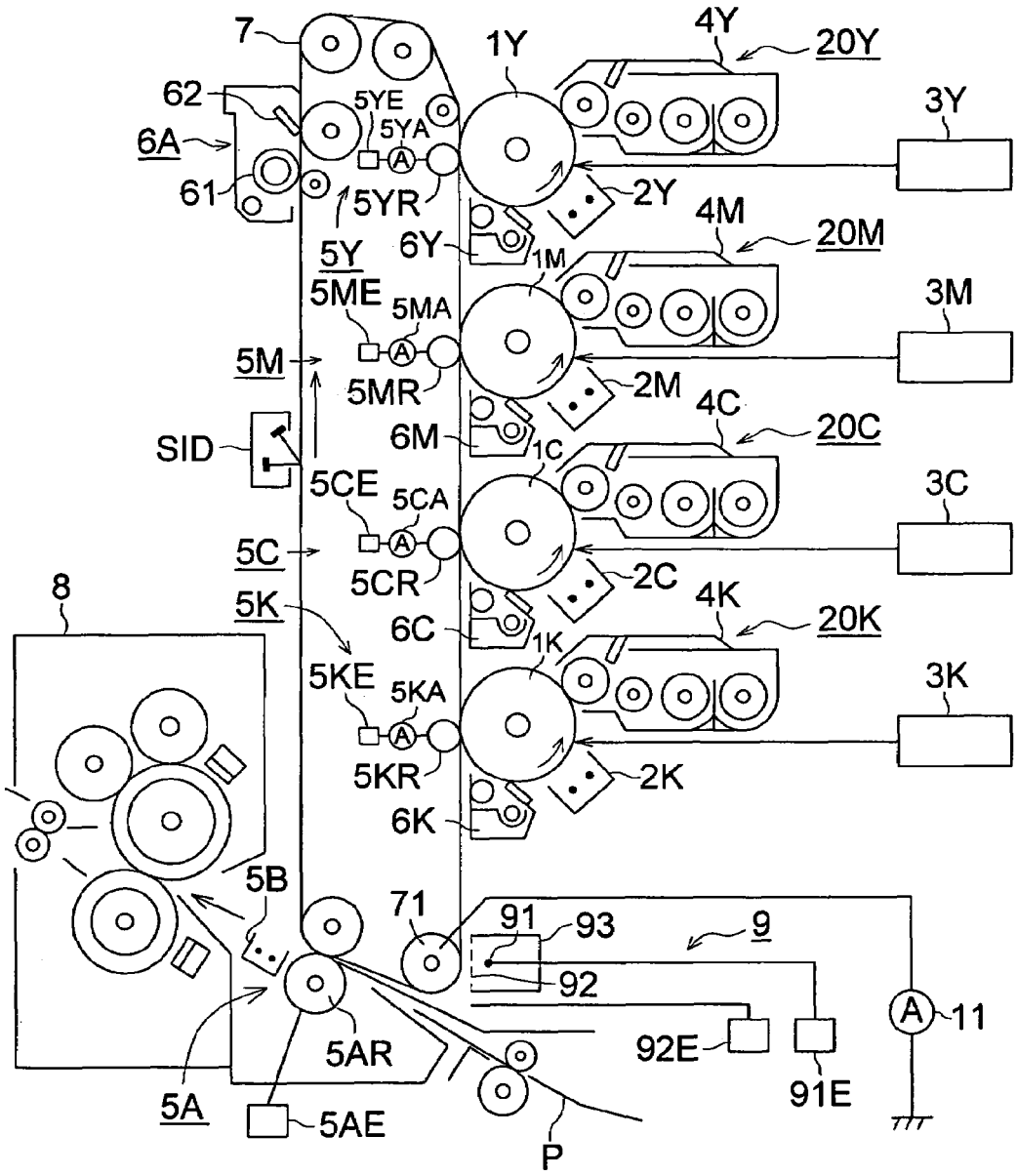
FIG. 1 is a structural drawing of a color image forming apparatus.

FIG. 1 is a drawing showing a color image forming apparatus relating to an embodiment of the present invention.

The color image forming apparatus called a tandem type color image forming apparatus includes a plurality of image forming sections 20Y, 20M, 20C, 20K, an intermediate transfer unit, a paper feeding device and fixing device 8.

Image forming section 20Y to form a yellow image has electric charging device 2Y, exposure device 3Y, developing device 4Y, primary transfer device 5Y and cleaning device 6Y provided at the circumference of photoconductor 1Y representing an image carrier. Image forming section M2 to form a magenta image has electric charging device 2M, exposure device 3M, developing device 4M, primary transfer device 5M and cleaning device 6M provided at the circumference of photoconductor 1M representing image carrier. Image forming section 20C to form a cyan image has electric charging device 2C, exposure device 3C, developing device 4C, primary transfer device 5C and cleaning device 6C provided at the circumference of photoconductor 1C as an image carrier. Image forming section 20K to form a black image has electric charging device 2K, exposure device 3K, developing device 4K, primary transfer device 5K and cleaning device 6K provided at the circumference of a photoconductor 1K representing as an image carrier.

A semi-conductive belt-shaped intermediate transfer member 7 is trained about a plurality of rollers to be supported to circulate.

An image forming device composed of electric charging device 2Y, exposure device 3Y and developing device 4Y carries out electric charging, exposure and developing onto photoconductor member 1Y so as to form a yellow image on the photoconductor member. In the same manner, an image forming device composed of electric charging device 2M, exposure device 3M and developing device 4M forms a magenta toner image on photoconductor member 1M, an image forming device containing electric charging device 2C, exposure device 3C and developing device 4C forms a cyan toner image on photoconductor member 1C, and an image forming device composed of electric charging device 2K, exposure device 3K and developing device 4K forms a black toner image on photoconductor member 1K. These single color images are transferred and superimposed onto intermediate transfer member 7 through transfer rollers 5Y, 5M, 5C, and 5K to form multi color toner image.

Meanwhile, a primary transfer power source 5Y(M, C, K,) E is connected to each of transfer rollers 5Y(M, C, K,) which are the primary transfer devices, via amperage meter 5Y(M, C, K,) A to detect a transfer current so that primary transfer is done under a predetermined transfer current when images are formed. In the present embodiment, transfer is done under the condition of transfer current of 30 μA and effective transfer of toner images onto intermediate transfer member 7 is done.

As photoconductor member 1, OPC photoconductor and aSi photoconductor which are widely knowen are used, and OPC photoconductor is preferred. In the present embodiment, negative electric OPC is used, because negative OPC photoconductor is particularly preferred.

As electric charging device 2, a corona discharging device such as scorotron or corotron are used and scorotron is preferably used.

As exposure device 3, a light emitting element such as laser or LED array that emits light according to image data is used.

As developing device 4, a developing device using two-component developer containing carrier and toner as main components or a developing device using single component developer containing toner without containing a carrier as a main component is used and a two-component developing device using small-particle toner is preferably used. Also toner for regular developing or toner for reversal developing can be used for the developing device. The reversal developing in which the developing is implemented with toner charged in the same polarity as that of the electric charge of photoconductor member by applying a bias voltage having the same polarity as that of the electric charge of photoconductor member 1 to developing sleeve 4*a*, is preferred. In the present embodiment, the development is implemented through reversal development by using negative charge toner.

As a small-particle toner, a toner with a volume average particle size of 3-6 μm is preferred.

The volume average particle size is an average particle size based on the volume standard and it is a value obtained through measurement by Coulter TA-II or Coulter Multisizer (Manufactured by Coulter Inc.) provided with wet type dispersion device.

With such a small-particle toner, a high quality image having higher resolution can be formed. Toner having a volume average particle size of more than 6 μm weakens the characteristic of high quality image.

With toner having a volume-average particle size of smaller than 3 μm, deterioration of image quality such as fogging tends to occur.

Also in the present invention, a spherical toner is preferred and its sphericity is preferred to be not less than 0.94 and not more than 0.98.

Sphericity=(the circumference length of a circle whose area is the same as the projected area of the particle)/(the circumference length of projected image of the particle)

To calculate the aforesaid sphericity, 500 resin particulates are photographed by magnifying them 500 times through a scanning type electron microscope or laser microscope, and image analyzer "SCANNING IMAGE ANALYZER" (Manufactured by Nippon Electronic) is used to analyze photo image to measure circularity. Thereby the sphericity can be calculated by obtaining an arithmetic mean value. Also, as a simple measuring method, it can be measured by FPIA-1000 (Manufactured by To a denshi Co., Ltd.)

In case the sphericity is smaller than 0.94, the toner particulate is comminuted by strong stress in the developing device which tends to result fogging or toner dispersing. Also in case sphericity is lager than 0.98, it is difficult to maintain high cleaning performance.

For toner having small particle and high sphericity, polymer toner is desirably to used.

The polymer toner means toner obtained by preparation of binder resin for toner, polymerization of ingredient monomer which toner shape is binder resin or pre-polymer and chemical process afterward. More specifically, the polymer toner means toner obtained through polymerization reaction such as suspension polymerization or emulsion polymerization, and fusion bonding between particles that is conducted afterward when necessary. In case of polymer toner, ingredient monomer or pre-polymer is dispersed in aqueous medium evenly, and then is polymerized to produce toner, so that toner having even distribution of particle size and uniform shape is obtained.

Specifically, it can be made by suspension polymerization or by a method wherein, in aqueous medium to which an emulsion liquid is added, monomeric substance is emulsion polymerized to make fine polymer particle, after that organic solvent and flocculating agent are added for association. There are given a method in which dispersion liquid such as mold release agent and dyeing agent which are needed for toner structure in association are mixed during association and a method in which after dispersing toner structuring components such as mold release agent and dyeing agent in monomeric substance, emulsion polymerization is carried out. Herein, association means a plurality of resin particles and particles of dyeing agent are agglutinated.

Symbol 5A represents a secondary transfer device including transfer roller 5AR made of conductive rubber roller and power source 5AE which applies a bias voltage of +5 kV and transfers a toner image on intermediate transfer member 7 onto transfer material in the present embodiment.

Intermediate transfer member 7 is a multilayer or a single layer belt made of a material of polyimide having a volume resistivity of $10^7$-$10^{12}$ Ωcm. In the present embodiment a material having a volume resistivity of $10^9$ Ωcm is used.

Symbol 6A represents a intermediate transfer member cleaning device to clean intermediate transfer member 7 and symbol 8 represents a fixing device to fix the toner image on transfer material P.

On the other hand, intermediate transfer member 7 passes through intermediate transfer cleaning device 6A to be cleaned after secondarily transfer by transfer roller 5A onto transfer material P.

Diffusion light type image density sensor SID having a light emitting element and a light receiving element is provided along intermediate transfer member 7 to detect an amount of toner adhesion on intermediate transfer member 7.

Symbol 9 is a pre-secondary transfer discharging device (hereinafter called discharging device as well) made of scorotron electric charging device, which has charging electrode 91 and grid 92.

In the color image forming apparatus of the present embodiment, discharging device 9 is provided between primary transfer device 5K which is provided along intermediate transfer member 7 and secondary transfer device 5A, and grid 92 faces the belt surface of intermediate transfer member 7 through a clearance of 1 mm, and support roller 71 which is grounded is provided behind intermediate transfer member 7.

adhesion amount electric potential is low remains unchanged. Through the control of this kind, the toner electric charge of high toner adhesion portion where the electric potential is higher than that of grid is reduced, and the performance of secondary transfer is improved, while the toner electric charge of low toner adhesion portion where the electric potential is lower than that of grid is not reduced, thereby, an neutralization having improved transfer conditions is carried out.

(2) Prior to the present invention, the inventors have carried out the following experimental tests using a color image forming apparatus shown in FIG. 1:

Using three kinds of developers in which an electric charge amount of toner is known, under an environment of low temperature and low humidity respectively of 10° C. and RH20%, a grid voltage of discharging device 9 was set at −50 V. Superimposed sold images were outputted on recording paper (64 g paper) having BLUE reverse surface with varying apply voltage to discharge electrode (wire) 91 (60 μm tungsten wire is used) to check color shading visually. Also forming thin line portion only by cyan 1 color on the same image, the status of toner dispersing was checked and evaluated. At the same time, the electric potential of solid image having one and two layers was monitored, by providing an unillustrated electric potential meter between discharging device 9 and secondary transfer device 5A.

TABLE 1

| Electric charge | Electric potential of toner layer before electric chage elimination | | Applied | Electric potential of toner layer after electric chage elimination | | | | |
|---|---|---|---|---|---|---|---|---|
| amount of toner | Solid 1 layer (V) | Solid 2 layers (V) | voltage to wire (kv) | Solid 1 layer (V) | Solid 2 layers (V) | Toner explosion | Color shading | Judgement |
| 40 μC/g | −90 | −170 | 5.5 | −30 | −70 | NG | OK | NG |
| | | | 5 | −45 | −80 | NG | OK | NG |
| | | | 4.5 | −55 | −100 | NG | OK | NG |
| | | | 4 | −95 | −120 | OK | OK | OK |
| | | | 3.5 | −90 | −145 | OK | NG | NG |
| 50 μC/g | −100 | −190 | 5.5 | −35 | −80 | NG | OK | NG |
| | | | 5 | −55 | −95 | NG | OK | NG |
| | | | 4.5 | −70 | −115 | OK | OK | OK |
| | | | 4 | −100 | −120 | OK | OK | OK |
| | | | 3.5 | −100 | −145 | OK | NG | NG |
| 60 μC/g | −110 | −210 | 5.5 | −45 | −90 | NG | OK | NG |
| | | | 5 | −65 | −110 | OK | OK | OK |
| | | | 4.5 | −75 | −125 | OK | OK | OK |
| | | | 4 | −110 | −150 | OK | NG | NG |
| | | | 3.5 | −110 | −155 | OK | NG | NG |

A direct current bias voltage is applied to discharge electrode 91 so as to discharge electricity having a polarity opposite to that of toner. For grid 92 and a side plate, a bias voltage is set to be the electric potential that is between a surface electric potential of maximum toner density on intermediated transfer member 7 and a surface electric potential of intermediate transfer member where the toner is not adhered.

Figure 2:
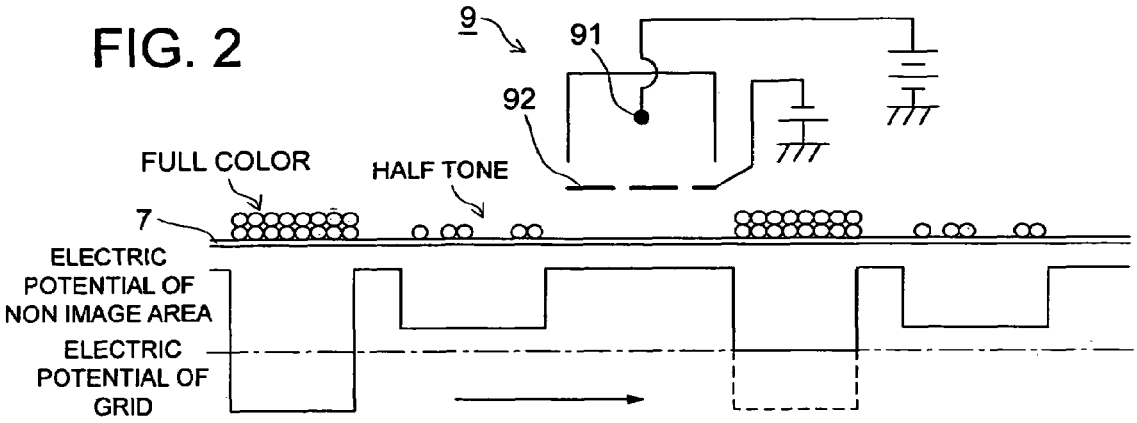
FIG. 2 is a schematic drawing showing a change of the voltage of toner layer before and after passing through the discharging device.

FIG. 2 is a schematic drawing showing a change of an electric potential of the toner layer on intermediate transfer member 7 before and after passing through discharging device 9 on which the bias voltage is applied. It indicates that though the electric potential of full color portion where toner adhesion amount electric potential is high is lowered, the electric potential of a half tone portion where toner Table 1 reveals that the voltage applied to discharge electrode (wire) 91 for obtaining good results concerning toner dispersing and color shading varies for toner having toner electric charge amount of 40-60 μC/g. In other word, a wire apply voltage of 4 kV is appropriate for a toner having electric charge amount of 40 μC/g, a wire apply voltage of 4-4.5 kV is appropriate for a toner having electric charge amount of 50 μC/g, and a wire apply voltage of 4.5-5 kV is appropriate for a toner having electric charge amount of 60 μC/g. It shows the voltage applied to discharge electrode (wire) 91 needs to be changed depending on the electric charge amount of the toner.

Next, using three kind of developer (40, 50, 60 μC/g) in which electric charge amount of toner is known, the development of solid image having the same amount of toner adhesion was carried out, and a toner image formed on photoconductor member 1 was transferred by varying the primary transfer current to 3 levels (15, 20, 30 μA), and an amount of toner adhesion on intermediate transfer member 7 was measured through image density sensor SID. Meanwhile, the primary transfer voltage of 30 μA is a condition to obtain good transfer rate used for image forming. Table 2 shows the relation among the electric charging amount of toner, the value of primary transfer current and the output from image density sensor SID.

TABLE 2

| | Output of image density sensor | | |
|---|---|---|---|
| Electric charge amount of toner | Transfer 15 μA | Transfer 20 μA | Transfer 30 μA |
| 40 μC/g | 2.4 V | 3.8 V | 4.0 V |
| 40 μC/g | 2.0 V | 3.3 V | 4.0 V |
| 40 μC/g | 1.6 V | 2.7 V | 4.0 V |

Figure 3:
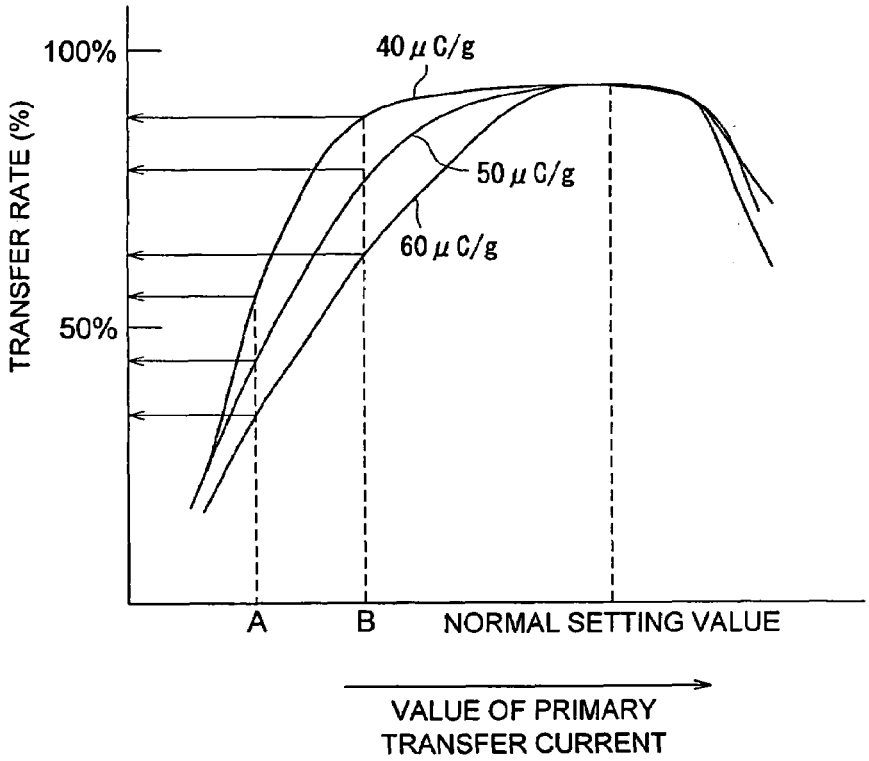
FIG. 3 is a graph showing a relationship between a value of the primary transfer current and a transfer rate concerning images having different electric charge amount of toner.

FIG. 3 shows this condition. In the figure, there are shown the transfer rates where solid images having different electric charge amount of toner formed on photoconductor member 1, were transferred using the same primary transfer current (A and B).

Figure 5:
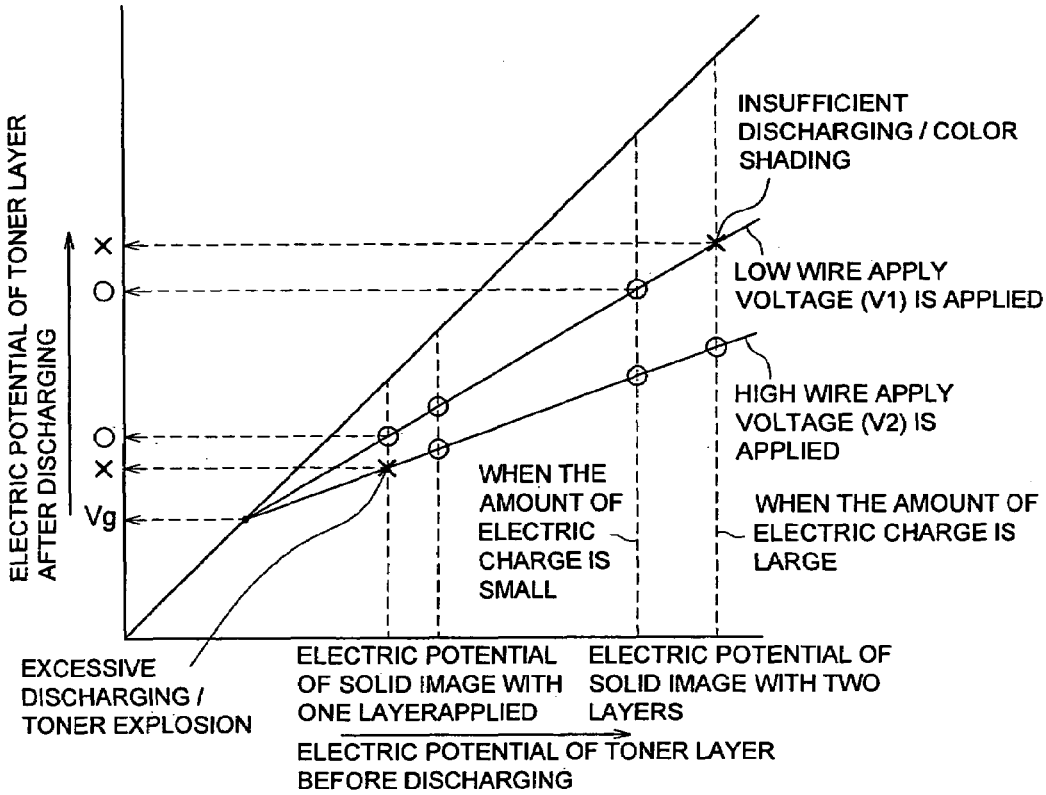
FIG. 5 is a graph showing a relationship between a voltage to be applied to the wire and an electric potential of toner layer before and after the neutralization.

FIG. 5 is a graph showing a relation between toner electric potentials before discharging and after neutralization when the voltage of discharge electrode (wire) 91 is set.

On the figure, the wire apply voltage exceeding the grid voltage (Vg) applied on grid 92 is shown with an oblique line and when the wire apply voltage is high voltage (V2), the inclination becomes gentle compared with low voltage (V1).

In case the voltage applied on the wire is a fixed value, when low voltage (V1) is set, the electric potential of toner layer after neutralization is in normal condition for two layer solid image having low electric charge, however, neutralization is insufficient and color shading occurs for two layer solid image having high electric charge amount. Also, when high voltage (V2) is set, for two layer solid image having high electric charge, the electric potential of toner layer after neutralization is in normal condition, however for one layer solid image having low electric charge amount, neutralization is excessive and toner dispersing occurs. Thus, it is indicated that the wire apply voltage needs to be controlled depending on the condition of toner as in the case of setting the wire apply voltage to low voltage (V1) for low electric charge amount and setting the wire apply voltage to high voltage (V2) for high electric charge amount.

(3) The table 2 shows that the transfer rate varies depending on electric charge amount of toner when the primary transfer is done at low primary transfer current compared to the primary transfer current of 30 μA by which preferable transfer rate is obtained for toner images having the same toner density. Thereby, by setting the primary transfer current to be lower than that of normal images forming, and by detecting the amount of adhesion of toner of the image transferred onto intermediate transfer member 7 through image density sensor SID, prediction of the charge amount of toner becomes possible.

Also, in case the charge amount of toner is known through table 1, by setting the voltage applied on discharge electrode (wire) 91 accordingly, whether the toner layer is one layer or two layers, preferable transferred images which are free from color shading and toner dispersion can be obtained.

Summarizing the results of the aforesaid studies leads to the followings:

By transferring a prescribed toner image formed on photoconductor member 1 onto intermediate transfer member 7 with primary transfer voltage lower than an ordinary one then, by detecting the image density of the image transferred on intermediate transfer member 7 through image density sensor SID and by setting voltage value applied on discharge electrode (Wire) 91 of discharging device 9, based on the output from image density sensor SID by using a predetermined table (image density sensor output−(electric charge amount of toner)−wire apply voltage value), a preferable transferred image can be obtained.

Meanwhile, to transfer a predetermined toner image by setting primary transfer voltage at 15 μA, and to set the voltage applied on discharge electrode (wire) 91 based on the output of image density sensor SID, table 3 obtained form the results of table 1 and 2 is used.

TABLE 3

| SID sensor output (V) | Wire apply voltage (kV) |
|---|---|
| 2.3-2.6 | 4 |
| 1.9-2.2 | 4.3 |
| 1.5-1.8 | 4.8 |

Figure 4:
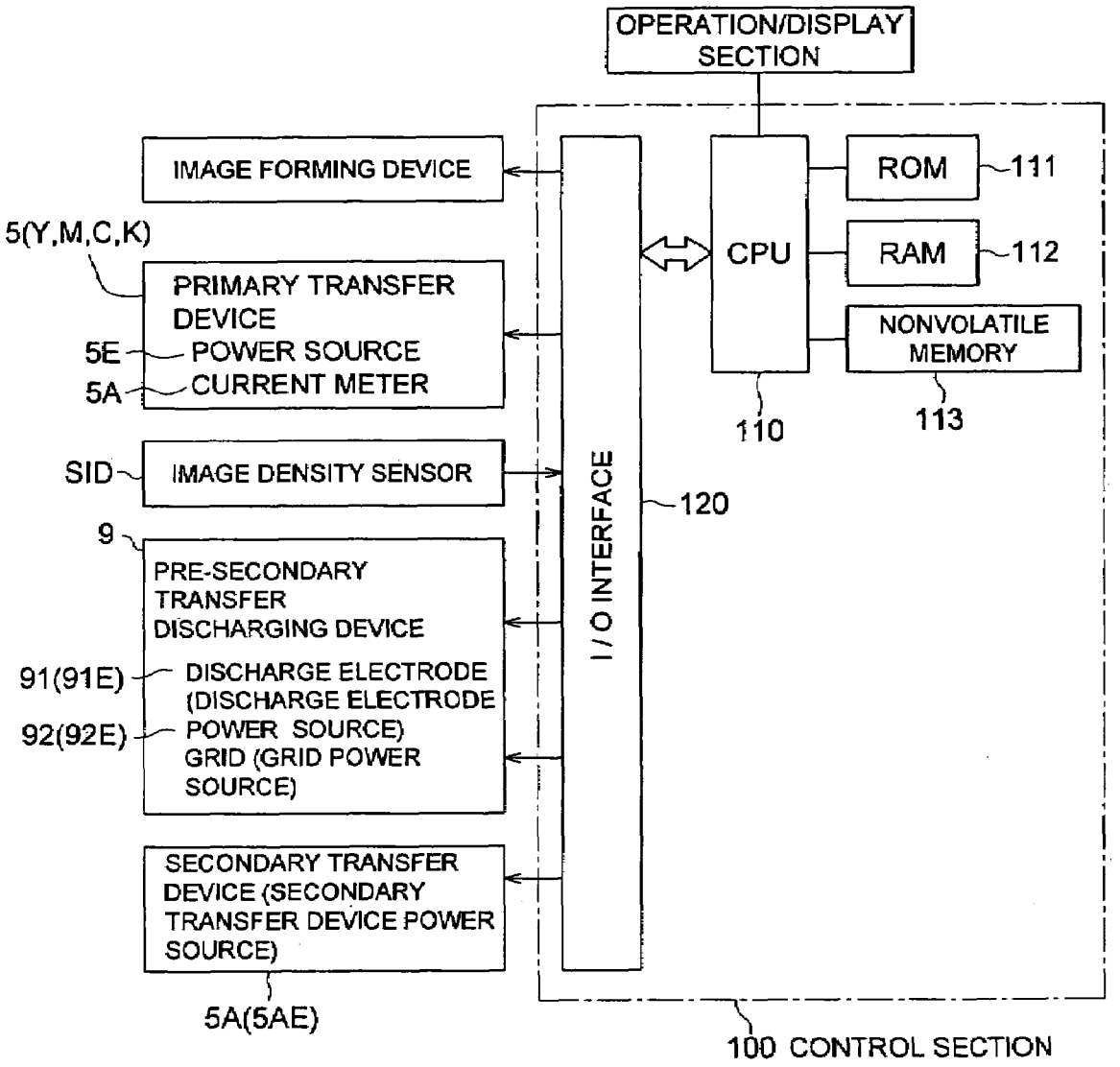
FIG. 4 is a block diagram showing the outline of an electric control system.

(4) FIG. 4 is a block diagram showing outline of electric control system. The numeral 110 represents a CPU to perform calculation control process to which ROM 111, RAM 112 and nonvolatile memory 113 are connected. In ROM 111, basic data for computation, image forming mode program, and a program to set the conditions of pre-secondary transfer neutralization are memorized. In nonvolatile memory 113, a table indicating a relation between the wire apply voltage and output from SID sensor shown in table 3 is stored. CPU 110 is connected with outer equipment through interface 120.

On the input side of interface 120, image density sensor SID is connected to input port. Also, on the output side of interface 120, power source 5Y (M, C, K) E for primary transfer device 5Y (M, C, K), grid power source 92E for discharging device 9, power source 91E for discharge electrode 91 and power source 5AE for secondary transfer device 5A in addition to an image forming device are connected to output port.

The color image forming apparatus shown in FIG. 1, is provided with operation/display section in which processing speed is set. After inputting the size of recording paper used and the number of prints, start button which commands starting of prints operation is pressed, then CPU 110 calls up an image forming mode program from ROM 111, and then image forming for the image data stored in the memory is carried out in accordance with the number of printing and process speed set.

In the present embodiment, in the course of the image adjusting mode such as warming-up mode, CPU 110 calls up a pre-secondary transfer neutralization condition setting program, and bias voltage applied on discharge electrode (wire) 91 is set.

Figure 6:
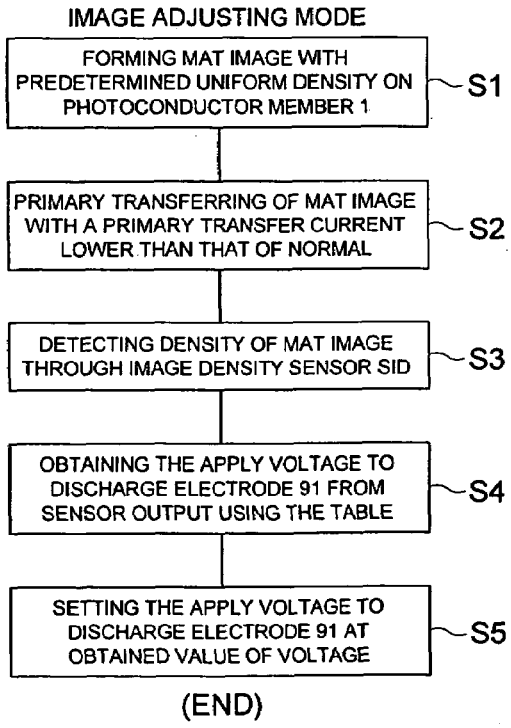
FIG. 6 is a block diagram showing a flow.

FIG. 6 shows a flow to set pre-secondary transfer neutralization conditions in image adjusting mode according to a program.

After giving exposure to photoconductor member 1 which is charged uniformly through electric charging device 2, through exposure device 3, CPU 110 forms a mat image having a prescribed uniform density by developing through developing device 4. (S1)

By driving power source 5E for primary transfer device 5 and by controlling to the primary transfer current value (15 μA in the present embodiment) that is lower than normal primary transfer current (30 μA in the present embodiment) by the use of current meter 5A, CPU 110 transfers a mat image onto intermediate transfer member 7. (S2)

CPU 110 detects density of the mat image on intermediate transfer member 7 using image density sensor SID (S3), then calls up (SID sensor output–applied voltage to wire) table from nonvolatile memory 113 and obtains the voltage applied on discharge electrode (wire) 91 of discharging device 9 from the sensor output of image density sensor SID (S4).

CPU 110 sets the voltage applied on discharge electrode (wire) 91 for forming an image at a voltage value obtained from the table for the period until image adjustment is newly completed (S5). Meanwhile, in the present embodiment, the voltage value applied to grid 92 of discharging device 9 is set to −50 V irrespective of sensor output of image density sensor SID.

Owing to the aforesaid process of image adjustment, good transferred images having neither color shading nor toner dispersing can be obtained in image forming.

According to the aforesaid embodiment, an electric charge amount of toner can be predicted by detecting an amount of toner adhesion on the secondary transfer member while the conditions of the primary transfer are changed. Whereby the electric charge amount of the toner is predicted from an output of the image density sensor which detects the amount of toner adhesion, and based on the result thereof, an applied voltage to the discharge electrode (wire) of the discharging device is set. Thus, even in case the electric charge amount of toner differs, an appropriate electric potential of toner layer can be always obtained by controlling neutralization through the neutralizating device. Thereby it has become possible to provide an image forming apparatus capable of preventing transfer of a color shading image caused by excessive amount of toner adhesion and of forming good images without toner dispersion even when the amount of toner adhesion is small.

What is claimed is:

1. A color image forming apparatus, comprising:

an intermediate transfer member;

a plurality of image forming sections provided along the intermediate transfer member;

a primary transfer device provided along the intermediate transfer member to transfer toner images formed on each the image forming section so that the toner images are superimposed on the intermediate transfer member;

a secondary transfer device provided at the downstream side of the primary transfer device to transfer superimposed toner images through a bias voltage;

a discharging device having a grid and a discharge electrode provided between the primary transfer device and secondary transfer device;

an image density sensor provided along the intermediate transfer member to detect an amount of toner adhesion on the intermediate transfer member;

a control device to control applied voltage for the discharge electrode in accordance with output of the image density sensor, wherein a patch image having a prescribed uniform density is formed and transferred onto the intermediate transfer member with a lower primary transfer current value than a normal primary transfer current value.

2. The color image forming apparatus of claim 1 wherein, a plurality of toner images having the same density formed on an image carrier is transferred by the primary transfer device with varying transfer conditions for each toner image, the image density sensor detects image densities of transferred toner images, and a voltage to be applied to the discharge electrode is obtained from the image densities and varied transfer conditions of primary transfer.

3. The color image forming apparatus of claim 2 wherein, a voltage to be applied to the discharge electrode is determined from the output of the image density sensor by the use of a predetermined table.

4. The color image forming apparatus of claim 1 wherein, an image adjusting mode is provided and the control device detects the amount of toner adhesion on the intermediate transfer member through image density sensor in the course of the image adjusting mode.

5. The color image forming apparatus of claim 1 wherein, the control section detects the amount of toner adhesion based on the patch image transferred on intermediate transfer member.

6. The color image forming apparatus of claim 1 wherein, the bias voltage having a polarity opposite to that of toner is applied to the electrode of the discharging section.

7. The color image forming apparatus of claim 6 wherein, the bias voltage having the same polarity as that of toner is applied to the grid.

8. The color image forming apparatus of claim 1 wherein, the bias voltage having a polarity opposite to that of toner is applied to the electrode of a discharging section and the bias voltage having an electric potential between a surface electric potential of maximum toner density on intermediated transfer member and a surface electric potential of intermediate transfer member where toner is not adhered, is applied on the grid.

* * * * *